US007331200B2

(12) United States Patent
Mista

(10) Patent No.: US 7,331,200 B2
(45) Date of Patent: Feb. 19, 2008

(54) KNITTING MACHINE

(75) Inventor: Kresimir Mista, Heusenstamm (DE)

(73) Assignee: Karl Mayer Textilmaschinenfabrik GmbH, Obertshausen (DE)

( * ) Notice: Subject to any disclaimer, the term of this patent is extended or adjusted under 35 U.S.C. 154(b) by 660 days.

(21) Appl. No.: 10/843,362

(22) Filed: May 12, 2004

(65) Prior Publication Data

US 2004/0261464 A1 Dec. 30, 2004

(30) Foreign Application Priority Data

May 13, 2003 (DE) ..... 103 21 331

(51) Int. Cl.
*D04B 27/26* (2006.01)

(52) U.S. Cl. ..... 66/207

(58) Field of Classification Search ..... 66/203, 66/204, 205, 206, 207
See application file for complete search history.

(56) References Cited

U.S. PATENT DOCUMENTS 3,044,283 A * 7/1962 Liebchen ..... 66/214
3,247,686 A * 4/1966 Lanthier ..... 66/207
4,761,973 A 8/1988 Gangi
6,050,111 A 4/2000 Nosaka et al.

FOREIGN PATENT DOCUMENTS

| | | |
|---|---|---|
| DE | 3734072 | 4/1989 |
| DE | 4217357 | 8/1994 |
| DE | 10243398 | 4/2003 |
| EP | 0921224 | 6/1999 |
| JP | 56-47288 | 3/1956 |
| JP | 59-17909 | 5/1984 |
| JP | 10-245754 | 9/1998 |

* cited by examiner

*Primary Examiner*—Danny Worrell
(74) *Attorney, Agent, or Firm*—Greenblum & Bernstein, P.L.C.

(57) ABSTRACT

Knitting machine that includes a plurality of guide bars, guides, associated with the plurality of guide bars, which are aligned to a working line, and drives, connected to the plurality of guide bars via coupling points, which are arranged next to one another in adjacent angle segments emanating from the working line and having a smaller width in an area adjacent the working line than in an area distant from the working line. The instant abstract is neither intended to define the invention disclosed in this specification nor intended to limit the scope of the invention in any way.

20 Claims, 3 Drawing Sheets

KNITTING MACHINE

CROSS-REFERENCE TO RELATED APPLICATIONS

The present application claims priority under 35 U.S.C. §119 of German Patent Application No. 103 21 331.7, filed on May 13, 2003, the disclosure of which is expressly incorporated by reference herein in its entirety.

BACKGROUND OF THE INVENTION

1. Field of the Invention

The invention relates to a knitting machine with several guide bars connected to drives via coupling points, the guides of which guide bars are aligned to a working line.

2. Discussion of Background Information

A knitting machine with several guide bars, which are also called "guide rails," is constructed so that the guide bars are arranged in a fan-shaped manner in cross section. The guides thus emanate outwards from the imaginary working line in the form of radial beams, whereby the space that is available for the guides is limited due to the other elements of the knitting machine, such as needles, pile sinkers, knock-over sinkers, etc. In principle, an angle segment is assigned to each guide bar. The angle area of such an angle segment is relatively small. It is only a few degrees, normally approx. 8 to 15°.

The guide bars are driven in the longitudinal direction in order to effect a displacement movement of the guides. This means that accelerating forces for the movement of the guide bars have to be applied so that they are directed in the direction of the longitudinal axis of the guide bars. Consequently connecting elements between the guide bars and their drives have to run parallel to one another and at a small distance from one another.

In older knitting machines, mechanical gearings were used for this, which meet these requirements rather well. One embodiment of mechanical gearings is formed by pattern disks. These have the disadvantage that they have to be replaced during pattern changes. This is associated with great expense. Long repeats are not possible with pattern disks. Pattern chains can be used here. However, the speed of the knitting machine has to be reduced when working with pattern chains.

In recent years, a change has increasingly been made to move the guide bars with the aid of motors. Motors that either interact with a mechanical linear gearing or directly comprise a linear electric drive, are well suited for rapid pattern changes. However, such motors need a relatively large space.

The space problem was solved by nesting and extension levers. However, disadvantages in terms of stability and energy consumption thus occur, because in part very large masses have to be moved.

In knitting machines that have several pattern guide bars in addition to several ground guide bars, the direct attachment of such drives is not possible for reasons of space.

SUMMARY OF THE INVENTION

The present invention renders possible a direct control of guide bars.

According to the invention, a knitting machine of the type mentioned at the outset includes drives arranged next to one another in adjacent angle segments that emanate from the working line and have a smaller width in an area adjacent to the working line than in an area distant from the working line.

Drives that respectively fit into the angle segments are thus used for the guide bars. It is thus possible to arrange all the drives in the axial direction, i.e., movement direction of the guide bars, at the same position. The drive conditions for the guide bars are the same. This is achieved in structural terms in that the drives are no longer embodied with a constant width (perpendicular to the movement direction of the drive rails) across their height, but with a width that decreases in the direction of the working line. The "working line" is hereby an imaginary line at which the guides would intersect if they were extended. It is not absolutely necessary hereby for the extensions of all the guides to intersect at the working line. Minor deviations are permissible. The fact that the drives are constructed narrower in an area closer to the working line than in an area that is further away from the working line, makes it possible to stagger the drives relatively compactly in the width direction and to accommodate them in the individual angle segments so that they do not obstruct one another. In this manner all the guide bars or guide rails can be driven by the same drives. A nesting or the use of different extension levers is not necessary.

Each drive preferably features a motor that is arranged further away from the working line than the coupling point. The coupling point can then be arranged relatively close to the working line so that the guide bars can be acted on by drive forces at a favorable point. The motor, which in principle forms the largest component of the drive, is installed at a larger radius in the angle segment. It is thus possible to embody the individual drives with a smaller width near the working line than further away from the working line.

The coupling point is preferably arranged at a first element that can be displaced relative to a second element to which the motor is fixed, whereby at least two parallel guiding devices are embodied between the first and the second element. The two guiding devices ensure that the first element maintains its alignment to the second element, i.e., to the motor, even when forces that are not in line with the drive forces generated by the motor act on the first element via the coupling point.

It is hereby preferred that at least one guiding device is arranged nearer to the working line than the motor. A guiding device that can be formed in principle by a straight rod has a much smaller width than the motor. It can now be ensured through the arrangement of the guiding device that the corresponding drive tapers in the width direction towards the working line.

The first element preferably features a second attachment point on at least one guiding device. This provides an additional support for the first element so that tipping or tilting is avoided, even when greater forces are transmitted to the guide bars.

It is hereby preferred that the second attachment point is arranged between two bearings of the guide point. The guiding device is thus supported on both sides of the attachment point so that the first element is held onto the drive with the necessary alignment, even in the case of greater forces.

The two guiding devices are preferably connected to each other twice. This is also a way of keeping the guiding devices parallel and thus of holding the first element in the desired alignment to the motor on the one hand and to the guide bar on the other.

One of the guiding devices preferably features a ball screw. A rotary motion of the motor can be transmitted to the first element in a simple and relatively low-loss manner via a ball screw. Space is saved if this ball screw is arranged in a guiding device, so that the drive does not need to be excessively wide at this point.

The motor is preferably arranged coaxially to the ball screw. Thus no additional gearing is required between the motor and the ball screw; instead, the motor can act directly on the ball screw.

In an alternative or additional embodiment it can be provided that the motor is connected via a rotating tension element to a gearing displacing the first element. Such a tension element can be formed by a chain, a toothed belt or the like. In this case the motor can be arranged relatively far away from the working line. The motor can thus be a certain size without the drives obstructing one another in the arrangement.

The drive preferably features a section that tapers towards the working line. This section can be formed, e.g., by a housing section with sloping walls. Such an embodiment facilitates assembly. The side walls of the tapering sections can be aligned parallel to one another and the drives can thus be assembled in an easy manner.

The present invention is directed to a knitting machine that includes a plurality of guide bars, guides, associated with the plurality of guide bars, which are aligned to a working line, and drives, connected to the plurality of guide bars via coupling points, which are arranged next to one another in adjacent angle segments emanating from the working line and having a smaller width in an area adjacent the working line than in an area distant from the working line.

According to a feature of the invention, each drive can include a motor positioned further away from the working line than the coupling point. Further, a first and second element may be structured and arranged for relative movement, such that the coupling point can be coupled to the first element and the second element is fixed to the motor. At least two parallel guiding devices can be positioned between the first and the second element. At least one of the at least two guiding devices may be located closer to the working line than the motor. The first element may include a second attachment point on at least one of the at least two guiding devices. Moreover, the second attachment point can be arranged between two bearings of the at least one guiding device. The at least two guiding devices can be connected to one another at least twice. Still further, one of the at least two guiding devices can include a ball screw. The motor may be arranged coaxially with the ball screw. Further still, a rotating tension element and a gearing structured and arranged to displace the first element can be provided, such that the motor is connected via the rotating tension element to the gearing.

In accordance with another feature of the invention, the drive may include a section that tapers towards the working line.

The present invention is directed to a process in a knitting machine. The process includes selectively guiding a plurality of guides in a radial direction toward a working line via drives having a width, in a circumferential direction, in an area adjacent the working line that is smaller than a width, in the circumferential direction, in an area distant from the working line.

In accordance with a feature of the invention, each guide can be driven independently of the other guides.

The present invention is directed to a knitting machine that includes a plurality of guides radially oriented with respect to a working line, and a plurality of drives arranged next to one another in adjacent angle segments emanating from the working line and having a width, in a circumferential direction, in an area adjacent the working line that is smaller than a width, in the circumferential direction, in an area distant from the working line.

According to a feature of the instant invention, a plurality of guide bars may be aligned with the plurality of guides and coupled to the plurality of drives. Further, each drive can include a motor positioned further away from the working line than a point at which the drive and the guide bar are coupled. Also, a plurality of push rods can be positioned to couple the plurality of guides to the plurality of drives.

Moreover, the plurality of guides can be arranged to span an angle of no more than 120°.

In accordance with still yet another feature of the present invention, an angle between adjacent guides can be between 8° and 15°.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figures 1, 2:
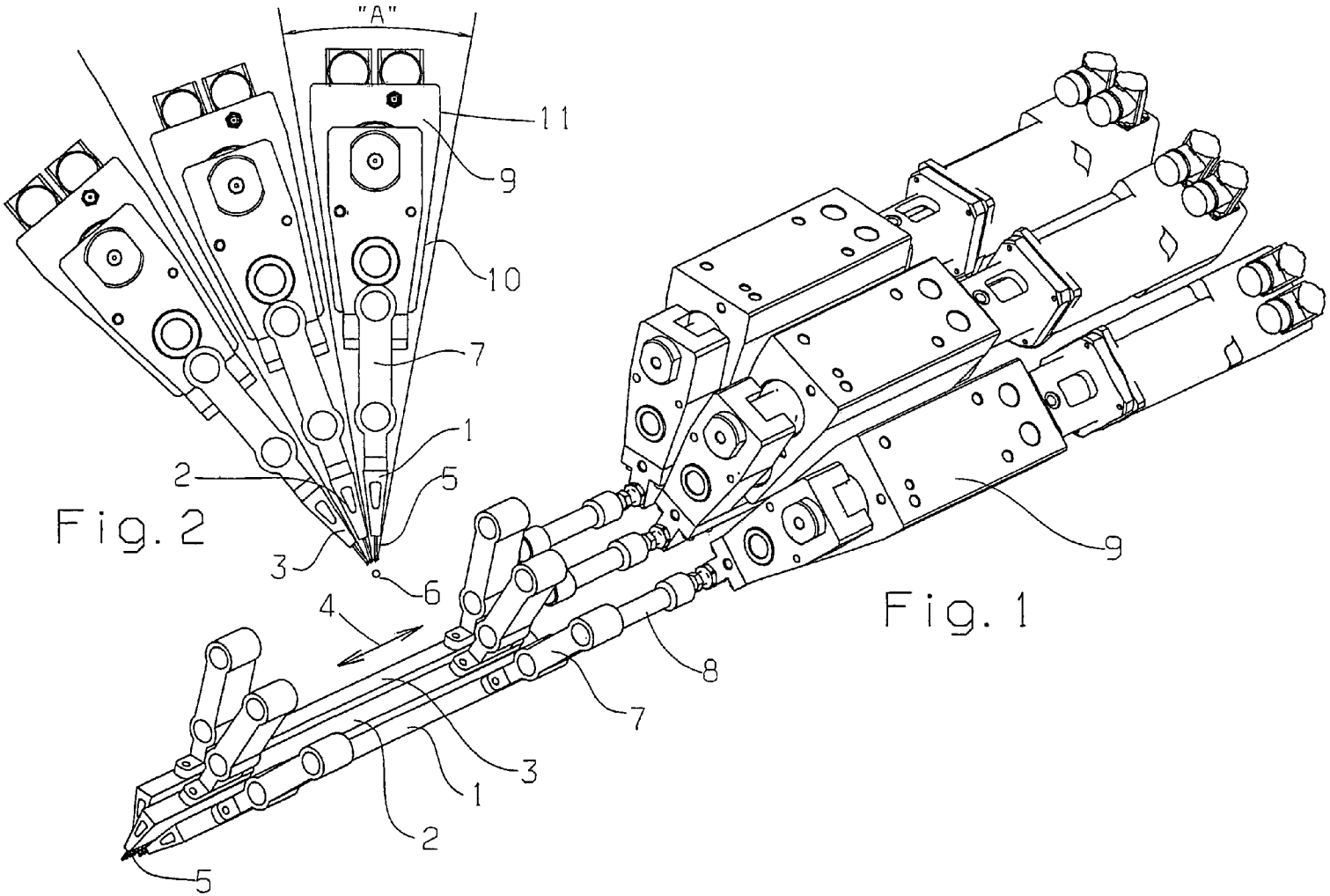
FIG. 1 diagrammatically illustrates a guide bar arrangement of a knitting machine.
FIG. 2 illustrates a front end view of the guide bar arrangement depicted in FIG. 1.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A knitting machine (not shown in further detail) features several guide bars 1-3 that are moved backwards and forwards in the direction of a double arrow 4 in order to place threads, which have been guided through guides 5, around other knitting elements, e.g., needles, in a predetermined manner.

In order to simplify the following explanation, a working line 6 is defined. This working line 6 is a virtual line. It is located at the intersection of the extensions of the guides 5 of the guide bars 1-3.

The guide bars 1-3 feature suspensions 7 with which they are attached in the knitting machine. Each suspension 7 is connected via a push rod 8 to a drive 9 that generates the axially directed force with which the guide bars 1-3 are moved backwards and forwards in the direction of the double arrow 4.

As can be seen from FIG. 2, the guide bars 1-3 are arranged with their suspensions 7 in a fan-shaped manner in cross section, i.e., an angle segment with an angle width "A" is available for each guide bar 1-3. Each angle segment thereby has a limited angle width A, as a rule 8 to 15°. The more guide bars are present, the smaller the angle segment, since the guide bars 1-3 cannot surround the working line 6 to the full extent. As a rule the space for the guide bars 1-3 is limited to a total of approx. 120°.

In order to be able to arrange the drives 9 as is shown in FIGS. 1 and 2, the drives have a special shape. They are embodied with a smaller width (in the circumferential direction) in an area that is adjacent to the working line 6 than at a greater distance. To this end each drive features at least one section 10 that tapers towards the working line 6. This section 10 does not need to extend over the entire height of the drive 9. A further section 11 can remain in which the walls of the drive 9 are aligned parallel to one another.

The push rod 8 engages the drive via a coupling point that is formed by a ball pin 12. The ball pin 12 is thereby inserted into a first element 13 of the drive 9 (FIG. 3) which first element can be displaced relative to a second element 14. A motor 15 is used for the displacement.

The ball pin 12, i.e., the coupling point, is located at a section of the drive 9 that is closest to the working line 6. The motor 15 is located at the opposite end of the drive 9 relative to the working line 6, i.e., where most space is available. This thereby takes into account the fact that in principle the motor 15 is the largest individual component of the drive 9.

The first element 13 features a first guiding device 17 supported in a linear bearing 16, which guiding device bears a nut 18 of a ball screw 19. The ball screw 19 is connected to a driven shaft 20 of the motor 15. When the motor 15 is in operation and the driven shaft 20 rotates, the first element 13 is displaced left or right relative to the second element 14 (with reference to the representation of FIG. 3) as a function of the rotation direction of the motor 15.

The first element 13 features a second guiding device 21 that is embodied as a guide shaft. The guiding device 21 is supported in two linear bearings 22, 23, that are spaced apart at a certain distance in the movement direction of the first element 13. The first element 13 is connected in this space or gap between the two bearings 22, 23 with a second attachment point 24 to the second guiding device 21. A very stable guidance of the first element 13 relative to the second element 14 is thus achieved, even if the forces acting on the first element 13 in the height direction (with respect to the representation of FIG. 3: from the bottom to the top) have a certain spacing. Through the support on two guiding devices 17, 21 and the two connections to the guiding device 21, the first element 13 is also sufficiently stable with respect to any moments occurring.

Figures 3, 4:
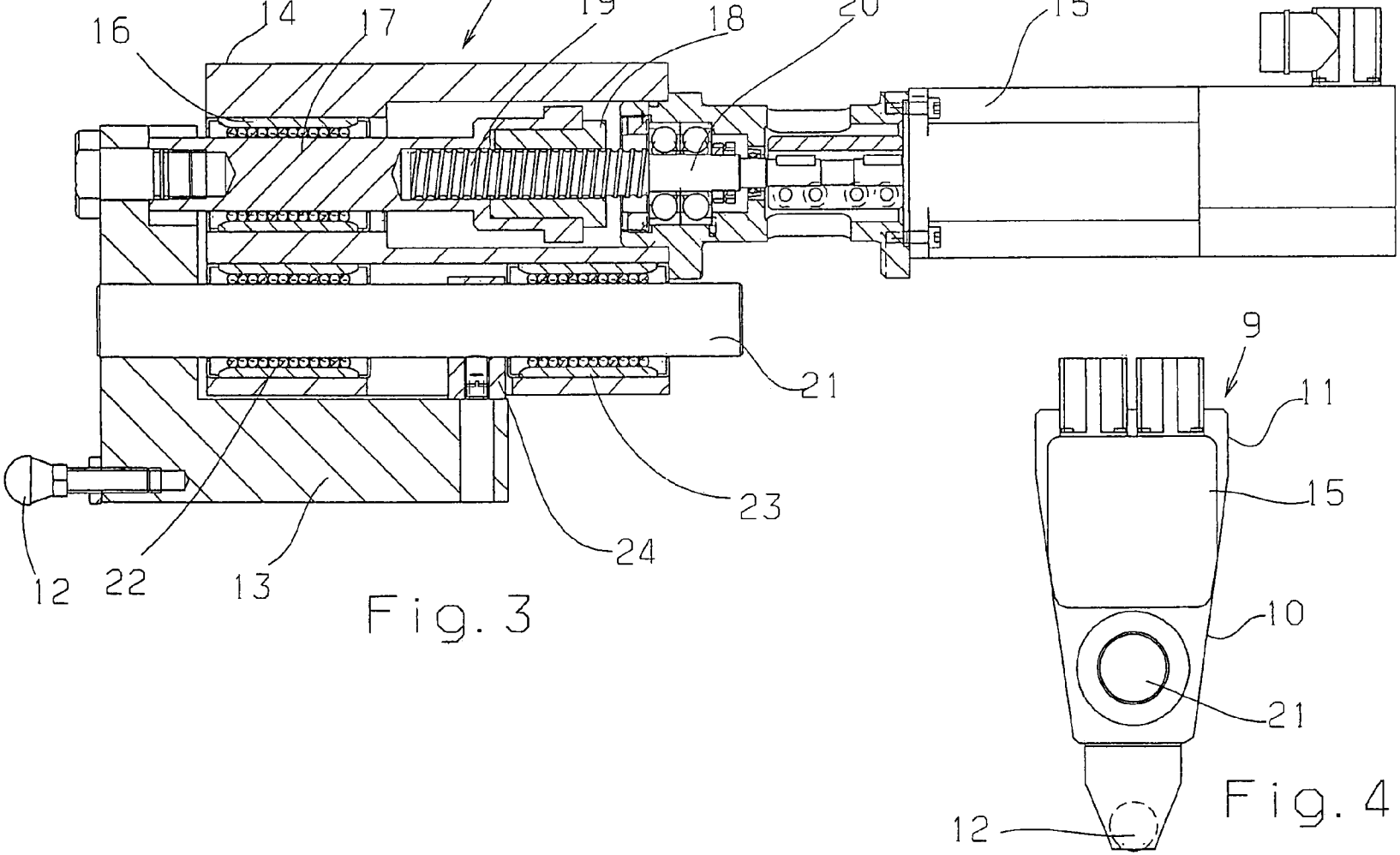
FIG. 3 illustrates a first embodiment of a drive in longitudinal section.
FIG. 4 illustrates a front end view of the drive arrangement.

Since the guiding device 21 has a much smaller width than the motor 15, the drive can taper from the top to the bottom to a sufficient extent, as can be seen from FIG. 4.

Figure 5:
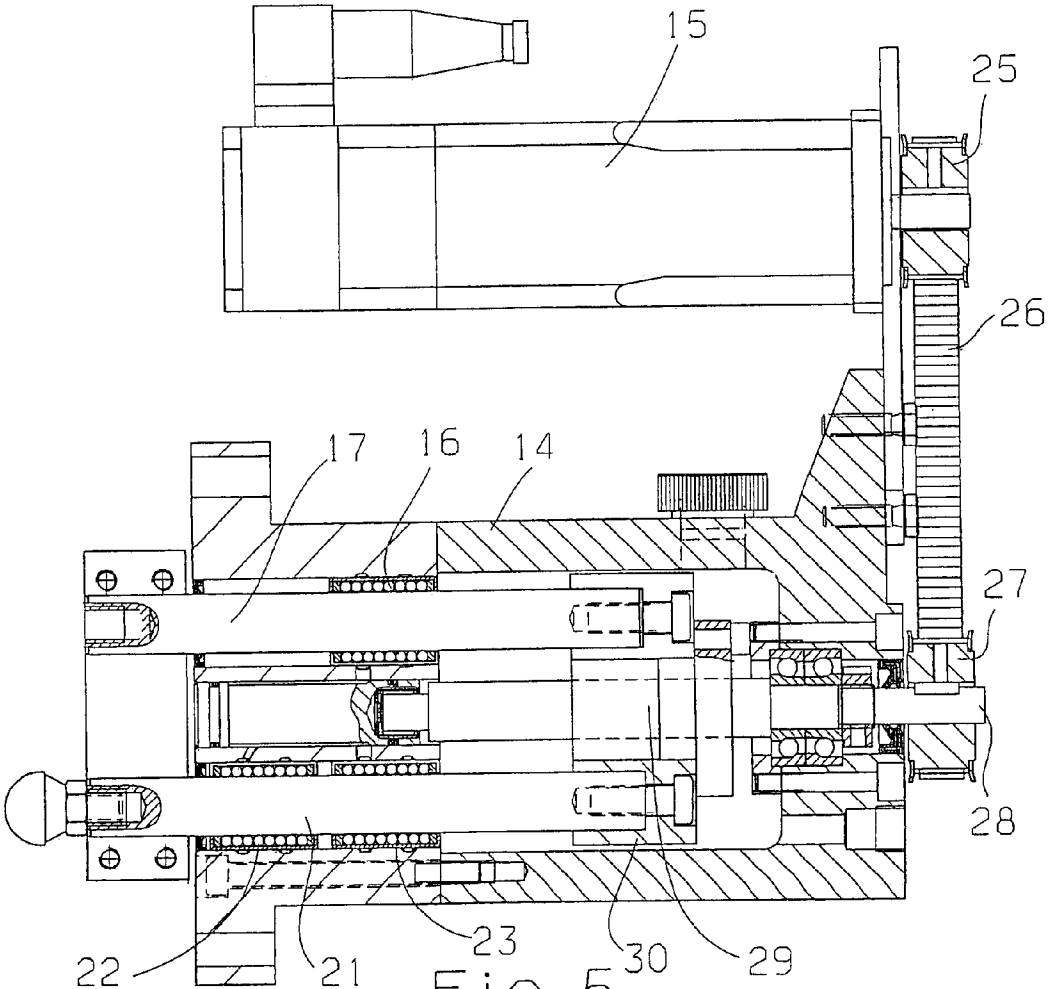
FIG. 5 illustrates a second embodiment of the drive in longitudinal section.
Figure 6:
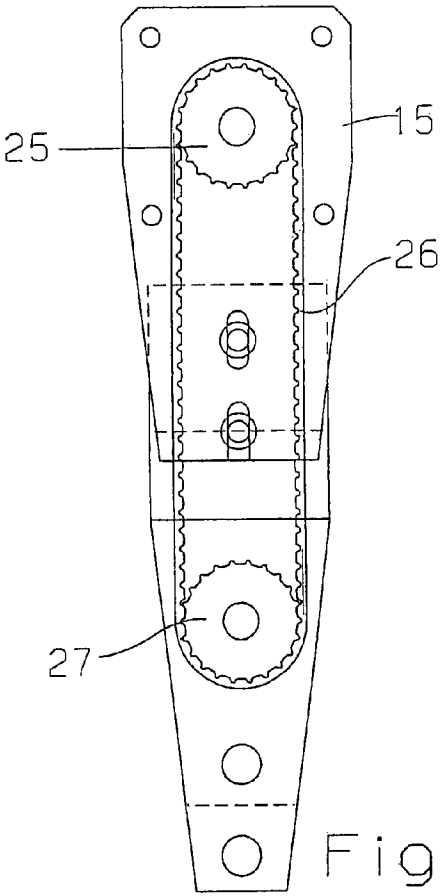
FIG. 6 illustrates a front end view of the drive depicted in FIG. 5.

FIGS. 5 and 6 show a modified embodiment. The same elements as in FIGS. 3 and 4 are provided with the same reference numbers.

The first element 13 to which the ball pin 12 is attached is supported in turn on two guiding devices 17 and 21 in the second element 14 in a displaceable manner. The linear bearings 16, 22, and 23 are provided for the support.

However, the motor 15 is not arranged coaxially to the guiding device 17. Instead the motor 15 is located above the second element 14. It features an output pinion 25 that engages via a toothed belt 26 with a drive pinion 27. The drive pinion 27 is rigidly fixed to a shaft 28 that drives the two guiding devices 17 and 21 via a gearing 29. The gearing 29 features an output element 30 that connects the two guiding devices 17 and 21 to one another.

The gearing 29 can also be formed here by a recirculating ball screw with associated nut.

Here the stability of the guidance is improved through the second connection of the two guiding devices 17 and 21 through the output element 30. The driving torque is introduced between the two guiding devices 17 and 21 so that the lever arm between the driving force that is introduced by the shaft 28 and the output force engaging on the ball pin 12 is not too large.

As can be seen from FIG. 2, the space between the individual drives 9 in the width direction is small. The drives 9 are attached independently of one another to a side wall (not shown in further detail) of a knitting machine. The walls in the tapering sections 10 thereby facilitate the reciprocal alignment.

The drives 9 for all the guide bars 1-3 can be embodied identically. This increases the ease of maintenance. The maintenance of supplies of spare parts is reduced. This means costs can be saved. Ease of maintenance is improved in that the individual drives 9 are also individually replaceable.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A knitting machine comprising:

a plurality of guide bars;

guides associated with said plurality of guide bars, which are aligned to a working line;

drives, connected to said plurality of guide bars via coupling points, which are arranged next to one another in adjacent angle segments emanating from the working line and having a smaller width in an area adjacent the working line than in an area distant from the working lines, wherein each drive comprises:

a first and second element structured and arranged for relative movement, wherein said coupling point is coupled to said first element; and at least two parallel guiding devices positioned between said first and said second element, wherein said first element comprises a second attachment point on at least one of said at least two guiding devices.

2. The knitting machine in accordance with claim 1, wherein each drive comprises a motor positioned further away from the working line than said coupling point.

3. The knitting machine in accordance with claim 2, wherein said second element is fixed to said motor.

4. The knitting machine in accordance with claim 2, wherein at least one of said at least two guiding devices is located closer to the working line than said motor.

5. The knitting machine in accordance with claim 1, wherein said second attachment point is arranged between two bearings of said at least one guiding device.

6. The knitting machine in accordance with claim 1, wherein said at least two guiding devices are connected to one another at least twice.

7. The knitting machine in accordance with claim 2, wherein one of said at least two guiding devices comprises a ball screw.

8. The knitting machine in accordance with claim 7, wherein said motor is arranged coaxially with said ball screw.

9. The knitting machine in accordance with claim 3, further comprising a rotating tension element and a gearing structured and arranged to displace said first element, wherein said motor is connected via said rotating tension element to said gearing.

10. The knitting machine in accordance with claim 1, wherein said drive comprises a section that tapers towards the working line.

11. A process in a knitting machine comprising:

selectively guiding a plurality of guides in a radial direction toward a working line via drives having a width, in a circumferential direction, in an area adjacent the working line that is smaller than a width, in the circumferential direction, in an area distant from the working line, wherein the drives are arranged at an axial end of the plurality of guides.

12. The process in accordance with claim 11, further comprising wherein each guide is driven independently of the other guides.

13. A knitting machine comprising:

a plurality of guides radially oriented with respect to a working line;

a plurality of drives arranged next to one another in adjacent angle segments emanating from the working line and having a width, in a circumferential direction, in an area adjacent the working line that is smaller than a width, in the circumferential direction, in an area distant from the working line, wherein said plurality of drives are located at an axial end of the plurality of guides.

14. The knitting machine in accordance with claim 13, further comprising a plurality of guide bars aligned with said plurality of guides and coupled to said plurality of drives.

15. The knitting machine in accordance with claim 14, wherein each drive comprises a motor positioned further away from the working line than a point at which said drive and said guide bar are coupled.

16. The knitting machine in accordance with claim 14, further comprising a plurality of push rods positioned to couple said plurality of guides to said plurality of drives.

17. The knitting machine in accordance with claim 13, wherein said plurality of guides are arranged to span an angle of no more than 120°.

18. The knitting machine in accordance with claim 13, wherein an angle between adjacent guides is between 8° and 15°.

19. The knitting machine in accordance with claim 1, wherein said drives are located at an axial end of said plurality of guides.

20. The knitting machine in accordance with claim 1, further comprising push rods coupled to actuate said guide rails.

* * * * *